US005568808A

United States Patent [19]

Rimkus

[11] Patent Number: 5,568,808

[45] Date of Patent: Oct. 29, 1996

[54] NOSE FILTERS

[75] Inventor: Ronald J. Rimkus, Flossmoor, Ill.

[73] Assignee: Amtec Products, Incorporated, Flossmoor, Ill.

[21] Appl. No.: 512,468

[22] Filed: Aug. 8, 1995

[51] Int. Cl.[6] ..... A62B 23/06

[52] U.S. Cl. ..... 128/206.11; 128/204.12; 128/204.13; 128/205.27

[58] Field of Search ..... 128/204.13, 204.12, 128/205.27, 205.29, 206.11, 846, 857, 858, 863

[56] References Cited

U.S. PATENT DOCUMENTS

| | | | |
|---|---|---|---|
| 1,823,094 | 1/1930 | Dylong | 128/204.12 |
| 2,057,397 | 10/1936 | Strauch | 128/204.13 |
| 2,241,472 | 2/1940 | Nemon | 128/206.11 |
| 2,277,390 | 3/1941 | Crespo | 128/204.12 |
| 2,526,586 | 9/1949 | Shuff | 128/204.12 |
| 2,660,166 | 11/1953 | Coleman | 128/204.12 |
| 3,884,223 | 5/1975 | Keindl | 128/206.11 |
| 4,052,983 | 10/1977 | Bovender | 128/206.11 |
| 4,106,502 | 8/1978 | Wilson | 128/203.11 |
| 4,573,461 | 3/1986 | Lake | 128/204.17 |

*Primary Examiner*—Vincent Millin
*Assistant Examiner*—V. Srivastava
*Attorney, Agent, or Firm*—Wallenstein & Wagner, Ltd.

[57] ABSTRACT

A disposable nose filter to be inserted in a nostril, including a flexible housing, a filter component and a flutter valve. The nose filter is adapted to be easily inserted and removed from the nostril. The flutter valve forms a seal with the lower exterior portion of the nostril, thus, forcing air through the filter and preventing air from passing between the housing and the inner walls of the nostril.

11 Claims, 1 Drawing Sheet

NOSE FILTERS

TECHNICAL FIELD

The present invention relates to disposable nose filters which, when positioned in a nasal passage of a nostril, form a seal with the lower exterior portion of the nostril. The nose filter purifies and warms the air, and also moistens the mucous membranes of the sinus cavity.

BACKGROUND OF THE INVENTION

Prior attempts to provide a disposable respiratory nose filter generally fall within one of two categories: mask-style nose filters, i.e., those which are designed to cover the exterior of the nostrils of the nose; and, intrusive-style nose filters, i.e., those which are designed to be inserted into a nasal passageway of the nose.

U.S. Pat. No. 5,392,773 and the patents listed therein generally disclose mask-like nose filters. Specifically, U.S. Pat. No. 5,392,773 discloses a mask-like filter which includes a meshed filter region surrounded by an adhesive region. The adhesive region further includes tabs which adhere to the base, lateral and tip portions of the nose.

U.S. Pat. Nos. 3,774,601 and 4,984,302 disclose the use of cotton, wool, polyethylene or polyester as a material used to filter particulate in a nose filter attached to the exterior of the nose. Both filters, however, cover a large portion of the facial area and can irritate the skin it comes is contact with. Generally speaking, mask-like nose filters are extremely awkward, cumbersome and unsightly. Further, when mask-like nose filters become wet, they cling or stick to the face of the wearer making it difficult to speak or breathe. Additionally, such nose filters lack aesthetic appeal.

Intrusive-style nose filters are disclosed in U.S. Pat. Nos. 3,457,917, 3,905,335, 4,052,983 and 5,417,205. U.S. Pat. No. 3,457,917 discloses a non-disposable nose filter which includes a filter retaining means (i.e., a housing), filtering material, and a detachable cap having a finger gripping means provided at the end of the cap. Unlike the present invention, the filter retaining means in U.S. Pat. No. 3,457,917 is formed from a hard molded plastic such as polytetrafluorethylene or Bakelite.

U.S. Pat. No. 3,905,335 discloses a nasal air filter comprising a pair of interconnected cylinders having a filter material contained within. The cylinders further contain yieldable flange means which engage the inner nostril walls.

U.S. Pat. No. 4,052,983 discloses a filter device insertable into the nasal passages which include a pair of flexible casings, each casing releasable receives a filter cartridge. The filter cartridges have a multitude of cilia-like, nylon filaments which act to electrostatically charge the air as it moves past the filaments, thus aiding in the filtering process.

U.S. Pat. No. 5,417,205 discloses an air filter comprised of two filter units linked by a connecting element. Each filter unit further comprises first and second gauze filters and a plurality of rods which extend from the first gauze filter to the second gauze filter and retain a stack of wet filter cloth between the gauze filters.

SUMMARY OF THE INVENTION

Generally, the present invention provides a hybrid style nose filter. The nose filter is adapted to be inserted into a nostril and includes a flexible housing, a filter component and a flutter valve. The housing may include an open bottom end, a top end having at least one air passageway, a cavity disposed between the top and bottom end, and a deformable side wall having a top portion and a bottom portion. The filter component is disposed in the cavity of the housing. The flutter valve has a diameter larger than the diameter of the nostril and extends radially outwardly from the filter component. Upon inhalation, the flutter valve forms a seal with the lower external portion of the nostril, forcing air to travel through the filter component and preventing air from passing between the housing and the inner walls of the nostril. Upon exhalation, the seal between the flutter valve and the external lower portion of the nostril is broken. This allows air to escape through both the filter component and the area between the housing and the inner wall of the nostril.

In a first aspect of the present invention there is provided a disposable nose filter which filters dust, germs, allergic matter, or other foreign particulate from the air passing through the nostrils into the sinus cavity. It has been found that as the air passes through the filter, the air is also warmed before it reaches the sinus cavity and eventually the lungs.

In another aspect of the present invention there is provided a disposable nose filter which forms a seal with the lower external portion of the nostril, thus, forcing air through the filter and preventing air from passing between the housing and the inner walls of the nostril. Only a small portion of the nose filter is exposed from the nostril. Accordingly, the nose filters of the present invention are aesthetically pleasing when worn, and are not cumbersome, awkward or unsightly like prior nose filters.

In yet another aspect of the present invention, there is provided a nose filter which moisturizes the mucous membranes of the sinus cavity and prevents dryness or irritation due to pollen, smoke, industrial chemicals, perfumes, dust, mold, and other allergenics.

In a final aspect of the present invention, there is provided a nose filter which can be easily inserted and removed from the nostril, and which will conform to the shape of the nasal passageway without irritating the sensitive inner wall of the nostril.

Other advantages and aspects of the present invention will become apparent upon reading the following description of the drawings and detailed description of the invention.

BRIEF DESCRIPTION OF THE DRAWINGS

While this invention is susceptible of embodiment in many different forms, there is shown in the drawings and will herein be described in detail preferred embodiments with the understanding that the present disclosure is to be considered as an exemplification of the principles of the invention and is not intended to limit the broad aspect of the invention to the embodiments illustrated.

DETAILED DESCRIPTION OF THE INVENTION

Figure 1:
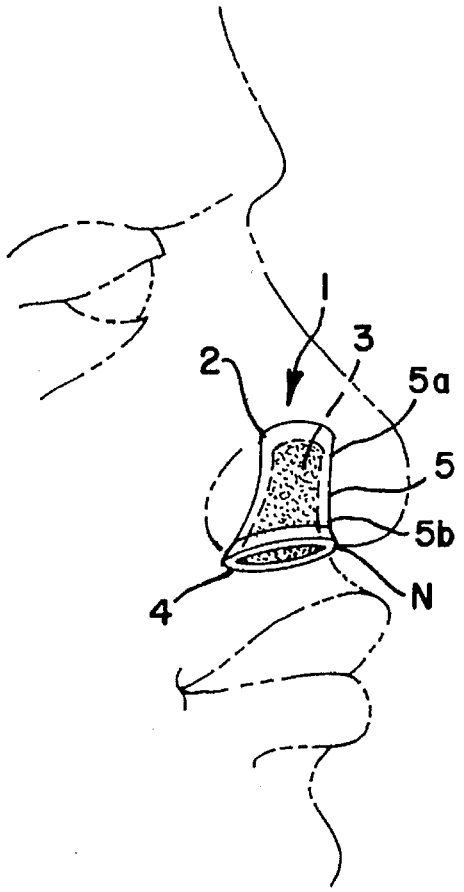
FIG. 1 is a view of a nose filter according to the present invention inserted into a nostril.
Figure 2:
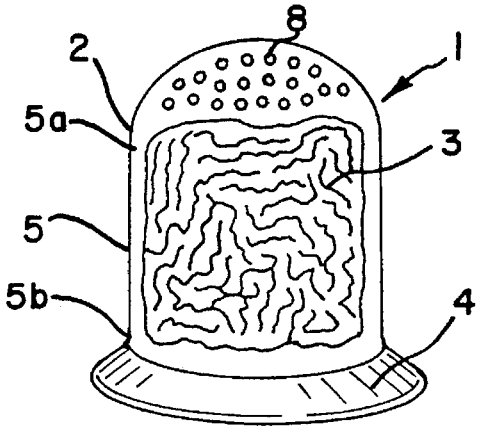
FIG. 2 is a longitudinal sectional view of the nose filter illustrated in FIG. 1 according to one embodiment of the present invention.

Referring now in detail to the drawings and initially to FIGS. 1 and 2, there is shown a preferred form of nose filter 1 constructed in accordance with the present invention. FIG. 1 illustrates the nose filter 1 inserted into nostril N. The nose filter 1 preferably comprises a flexible housing 2, a filter component 3, and a flutter valve 4. The flexible housing 2 has an open bottom end, a top end having at least one air passageway 8, a cavity disposed between the top and bottom ends of the housing, and a deformable side wall 5 having a top portion 5*a* and a bottom portion 5*b*. In the embodiment illustrated in FIG. 2, the top end of the flexible housing 2 has a plurality of air passageways 8. The filter component 3 has a top portion and a bottom portion and is disposed within the housing cavity. The flutter valve 4 has a diameter larger than the diameter of the nostril N, and can be connected at one end to either the bottom portion 5*b* of the deformable side wall 5, or to the bottom portion of the filter component 3. In either embodiment, the flutter valve 4 extends radially outwardly from the filter component 3 so that when the nose filter 1 is inserted into the nostril N, the flutter valve 4 is partially exposed from the nostril N. This allows for the nose filter 1 to be easily removed from the nostril N. In the embodiment where the flutter valve 4 is connected to the bottom portion 5*b* of the deformable side wall 5 (i.e., FIG. 2), the flutter valve 4 may be molded integral with the bottom portion 5*b* of the deformable side wall 5.

Generally, the flutter valve 4 will be considerably thinner than the flexible housing 2, preferably less than half the thickness of the deformable side wall 5 of the housing 2. Therefore, as the person wearing the nose filter 1 breathes, the flutter valve 4 moves up and down. As best illustrated in FIG. 1, upon inhalation, the flutter valve 4 forms a seal with the external lower portion of the nostril N. This seal forces air through the filter component 3 and also prevents air from passing between the deformable side wall 5 of the housing 2 and the inner walls of the nostril N. Thus, all the air entering the sinus cavity will be filtered. Upon exhalation, the seal between the flutter valve 4 and the external lower portion of the nostril N is broken. This allows air to escape through both the filter component 3 and the area between the deformable side wall 5 of the housing 2 and the inner wall of the nostril N. As a result, the nose filter 1 of the present invention is less constraining and more readily simulates normal breathing by the wearer.

Figure 3:
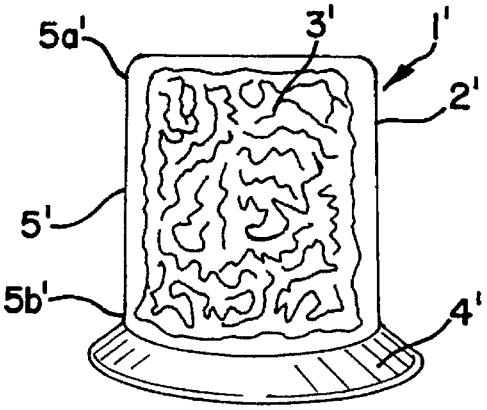
FIG. 3 is a longitudinal sectional view of the nose filter illustrated in FIG. 1 according to a second embodiment of the present invention.
Figure 4:
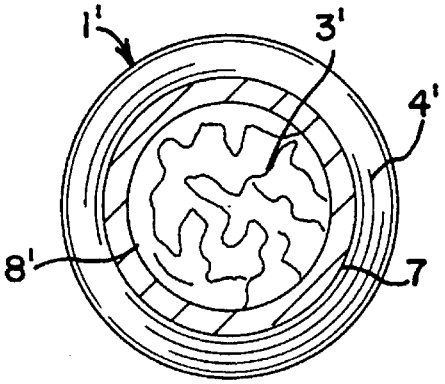
FIG. 4 is a top plan view of the nose filter illustrated in FIG. 3; and, FIG. 5 is a longitudinal sectional view of the nose filter illustrated in FIG. 1 according to a third embodiment of the present invention.

Referring now to FIGS. 3 and 4, in a second embodiment of nose filter 1' of the present invention, the top end of flexible housing 2' consists of a large air passageway 8' and retaining ridge 7. Retaining ridge 7 prevents filter component 3' from being dislodged from the flexible housing 2' during the breathing process. Like the nose filter 1 illustrated in FIG. 2, the flutter valve 4' of nose filter 1' illustrated in FIGS. 3 and 4 can be connected at one end to either the bottom portion 5*b*' of the deformable side wall 5' or to the bottom portion of the filter component 3'.

Figure 5:
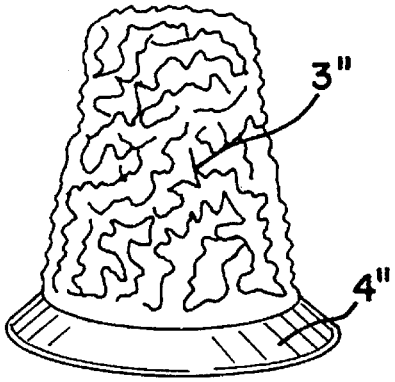

With reference to FIG. 5, in a third embodiment of the present invention, nose filter 1" consists solely of filter component 3" and flutter valve 4". Flutter valve 4" can be connected to the bottom portion of filter component 3" by a heat treatment which essentially fuses the materials of the filter component 3" and flutter valve 4" together, or it can be connected by any conventional, non-toxic adhesive.

In all three embodiments of the present invention, any suitable material such as cotton or a cellulose material may be used to form filter component 3, 3' and 3". However, in a preferred embodiment, filter component 3, 3' and 3" consists of a sponge-like absorbing material. The sponge-like material may further be soaked in a saline solution, herbal or vitamin oil, or any aqueous solution.

In the embodiments of the present invention illustrated in FIGS. 1–4, any suitable plastic or rubber-like material which is non-toxic and which will not irritate the inner wall of the nostril may be used to form flexible housing 2, 2'. In a preferred embodiment flexible housing 2, 2' is formed from a synthetic rubber latex. However, the present invention also contemplates embodiments where flexible housing 2, 2' comprises a natural porous material such as cotton, linen, gauze or the like. It has been found that when flexible housing 2, 2' is formed from a plastic or rubber-like material and the nose filter 1, 1' is inserted into the nostril, flexible housing 2, 2' also aids in forcing the nasal passageway open, thus allowing more air to pass through the nose filter 1, 1' and into the sinus cavity.

When the nose filters of the present invention are not in use, they may be kept in a convenient container filled with a saline or other aqueous solution to keep the filter component moist. It will also be understood that the size and shape of the nose filters of the present invention may be varied to accommodate noses of different sizes and shapes.

While the specific embodiments have been illustrated and described, numerous modifications come to mind without markedly departing from the spirit of the invention. The scope of protection is only intended to be limited by the scope of the accompanying claims.

What I claim is:

1. A nose filter for insertion into a nostril, the nostril having a diameter and including an inner wall and an external lower portion, the nose filter comprising:

a flexible housing having an open bottom end, a top end having at least one air passageway, a deformable side wall having a top portion and a bottom portion, and a cavity located between the top end and the bottom end of the housing;

a filter component disposed in the housing cavity, the filter component having a top portion and a bottom portion; and, a valve having a diameter larger than the diameter of the nostril and extending radially outwardly from the filter component, upon insertion of the nose filter into the nostril, the valve being partially exposed from the nostril;

upon inhalation, the valve forms a seal with the lower external portion of the nostril forcing air to travel through the filter component and preventing air from passing between the housing and the inner wall of the nostril; and, upon exhalation, the seal formed between the valve and the lower external portion of the nostril is broken.

2. The nose filter of claim 1, wherein the valve is connected to the lower portion of the filter component.

3. The nose filter of claim 1, wherein the valve is connected to the lower portion of the deformable side wall of the flexible housing.

4. The nose filter of claim 1, wherein the flexible housing comprises a synthetic rubber latex.

5. The nose filter of claim 1, wherein the thickness of the valve is less than half the thickness of the deformable side wall of the flexible housing.

6. The nose filter of claim 1, wherein the flexible housing comprises a natural porous material selected from the group consisting of cotton, linen, and gauze.

7. The nose filter of claim 1, wherein the filter component comprises an absorbent material.

8. The nose filter of claim 7, wherein the absorbent material is soaked in an aqueous solution.

9. A nose filter for insertion into a nostril, the nostril having a diameter and including an inner wall and an external lower portion, the nose filter comprising:

a filter component having a top portion and a bottom portion; and, a valve having a diameter larger than the diameter of the nostril and extending radially outwardly from the filter component, upon insertion of the nose filter into the nostril, the valve being partially exposed from the nostril;

upon inhalation, the valve forms a seal with the lower external portion of the nostril forcing air to travel through the filter component and preventing air from passing between the housing and the inner wall of the nostril; and, upon exhalation, the seal formed between the valve and the lower external portion of the nostril is broken.

10. The nose filter of claim 9, wherein the valve comprises a synthetic rubber latex.

11. The nose filter of claim 9, wherein the filter component comprises an absorbent material.

* * * * *